US007304195B2

(12) United States Patent
Choi et al.

(10) Patent No.: US 7,304,195 B2
(45) Date of Patent: Dec. 4, 2007

(54) PROCESS FOR INCREASING PRODUCTION OF BENZENE FROM HYDROCARBON MIXTURE

(75) Inventors: Sun Choi, Daejeon (KR); Seung Hoon Oh, Seoul (KR); Kyoung Hak Sung, Daejeon (KR); Jong Hyung Lee, Daejeon (KR); Sin Choel Kang, Seoul (KR); Yong Seung Kim, Daejeon (KR); Byeung Soo Lim, Daejeon (KR); Byoung Mu Chang, Daejeon (KR)

(73) Assignee: SK Corporation, Seoul (KR)

( * ) Notice: Subject to any disclaimer, the term of this patent is extended or adjusted under 35 U.S.C. 154(b) by 252 days.

(21) Appl. No.: 11/226,674

(22) Filed: Sep. 13, 2005

(65) Prior Publication Data

US 2006/0287564 A1 Dec. 21, 2006

(30) Foreign Application Priority Data

Jun. 21, 2005 (KR) ..... 10-2005-0053619

(51) Int. Cl.

| | |
|---|---|
| ***C07C 15/12*** | (2006.01) |
| ***C07C 4/18*** | (2006.01) |
| ***C10G 35/06*** | (2006.01) |
| ***C10G 47/00*** | (2006.01) |

(52) U.S. Cl. ..... 585/489; 585/475; 585/833; 208/137; 208/138; 208/111.1; 208/111.35

(58) Field of Classification Search ..... 585/489, 585/475, 833; 208/111.1, 111.35, 137, 138
See application file for complete search history.

(56) References Cited

U.S. PATENT DOCUMENTS

| | | | | |
|---|---|---|---|---|
| 3,729,409 | A | | 4/1973 | Chen |
| 3,928,174 | A | * | 12/1975 | Bonacci et al. ..... 208/80 |
| 4,058,454 | A | | 11/1977 | Asselin |
| 6,635,792 | B2 | | 10/2003 | Choi et al. |

* cited by examiner

*Primary Examiner*—Thuan Dinh Dang
(74) *Attorney, Agent, or Firm*—Darby & Darby P.C.

(57) ABSTRACT

A process for increasing the production of benzene from a hydrocarbon mixture. A process for producing an aromatic hydrocarbon mixture and liquefied petroleum gas (LPG) from a hydrocarbon mixture, and a solvent extraction process for separating and recovering polar hydrocarbons from a hydrocarbon mixture containing polar hydrocarbons (that is, aromatic hydrocarbons) and nonpolar hydrocarbons (that is, non-aromatic hydrocarbons) are integrated, thereby it is possible to increase the production of benzene.

6 Claims, 2 Drawing Sheets

PROCESS FOR INCREASING PRODUCTION OF BENZENE FROM HYDROCARBON MIXTURE

INCORPORATION BY REFERENCE

The present application claims priority under 35 U.S.C. §119 to Korean Patent Application No. 10-2005-0053619 filed on Jun. 21, 2005. The content of the application is incorporated herein by reference in its entirety.

BACKGROUND OF THE INVENTION

1. Field of the Invention

The present invention relates to a process for increasing the production of benzene from a hydrocarbon mixture. More particularly, the present invention pertains to a process for increasing the production of benzene by integrating a process for producing an aromatic hydrocarbon mixture and liquefied petroleum gas (LPG) from a hydrocarbon mixture with a solvent extraction process for separating and recovering polar hydrocarbons from the hydrocarbon mixture.

2. Description of the Related Art

Generally, aromatic hydrocarbons are obtained by separating a feedstock fraction, which is rich in aromatic compounds, such as reformates produced through a catalytic reforming process and pyrolysis gasolines produced through a naphtha cracking process, from non-aromatic hydrocarbons using a solvent extraction process. The aromatic hydrocarbon mixture thus obtained is separated into benzene, toluene, xylene, and $C_9$+ (compounds having 9 or more carbons)aromatic compounds using a difference in boiling point to use them as basic petrochemical materials, and the non-aromatic hydrocarbons are used as a feedstock or a fuel for the naphtha cracking process.

With respect to this, U.S. Pat. No. 4,058,454 discloses a solvent extraction process for separating and recovering polar hydrocarbons from a hydrocarbon mixture containing the polar hydrocarbons and nonpolar hydrocarbons. Most solvent extraction processes, as well as the above patent, take advantage of the fact that all aromatic hydrocarbons are polar. That is to say, if a solvent capable of dissolving polar material, such as sulfolane, therein is added to a hydrocarbon mixture, polar aromatic hydrocarbons are selectively dissolved and thus separated from nonpolar non-aromatic hydrocarbons. This process has an advantage in that it is possible to produce a highly pure aromatic hydrocarbon mixture, but is disadvantageous in that an additional solvent extraction device is necessary and a solvent must be continuously supplied during operation. Accordingly, there remains a need for a process for separating aromatic hydrocarbons and non-aromatic hydrocarbons from feedstock oil without an additional solvent extraction step.

In connection with this, effort has been made to employ another reaction system instead of a solvent extraction process in order to separate aromatic compounds from non-aromatic compounds. The non-aromatic compounds which are mixed with the aromatic compounds are converted into gaseous hydrocarbons through a hydrocracking reaction using a catalyst, and the aromatic compounds and the non-aromatic compounds are separated from each other using a gas-liquid separator at a rear part of a reactor. This technology has been developed from U.S. Pat. No. 3,729,409.

Furthermore, a process for producing aromatic hydrocarbons and LPG from a hydrocarbon mixture, in which aromatic compounds of the hydrocarbon mixture are converted into a fraction including benzene, toluene, xylene and the like through dealkylation and/or transalkylation reactions, and non-aromatic compounds are converted into gaseous material that is rich in LPG through a hydrocracking reaction, has been studied.

The above-mentioned processes, respectively, which have the common object of producing aromatic hydrocarbon products, such as benzene, toluene, or xylene, have been independently developed as competitive, or complementary/substitution technologies. However, a process for improving productivity of aromatic hydrocarbons, particularly, benzene, by integrating competing processes has not yet been suggested.

SUMMARY OF THE INVENTION

Leading to the present invention, the intensive and thorough research on production of benzene, carried out by the present inventors aiming to avoid the problems encountered in the prior arts, resulting in the finding that, when a process for producing an aromatic hydrocarbon mixture and LPG from a hydrocarbon mixture and a solvent extraction process for separating and recovering polar hydrocarbons from a hydrocarbon mixture are integrated, it is possible to improve the productivity and efficiency of each process or of the integrated process, thereby accomplishing the present invention.

Therefore, it is an object of the present invention to provide a process for increasing the productivity of products by integrating two processes which have different functions and compete with or complement each other.

It is another object of the present invention to provide a process for increasing the production of benzene from a hydrocarbon mixture so as to improve productivity.

In order to accomplish the above objects, according to an embodiment of the present invention, there is provided a process for increasing the production of benzene from a hydrocarbon mixture, including the following steps of:

separating a hydrocarbon feedstock into a $C_6$ or lower hydrocarbon stream and a $C_7$ or higher hydrocarbon stream;

separating the $C_6$ or lower hydrocarbons into a non-aromatic hydrocarbon stream and an aromatic hydrocarbon stream through a solvent extraction process;

recovering benzene from the aromatic hydrocarbon stream;

feeding the $C_7$ or higher hydrocarbons and hydrogen into at least one reaction area;

converting the $C_7$ or higher hydrocarbons in presence of a catalyst in the reaction area into aromatic hydrocarbons which are rich in benzene, toluene, and xylene through dealkylation/transalkylation reactions, and non-aromatic hydrocarbons which are rich in liquefied petroleum gas through a hydrocracking reaction;

separating reaction products of the converting step into an overhead stream, which contains hydrogen, methane, ethane, and the liquefied petroleum gas, and a bottom stream, which contains the aromatic hydrocarbons, and a small amount of hydrogen and non-aromatic hydrocarbons, using a gas-liquid separation process; and recovering benzene, toluene, xylene, and $C_9$ or higher aromatic compounds, respectively from the bottom stream.

It is preferable that the benzene and benzene, toluene, xylene, and $C_9$ or higher aromatic compounds recovering steps be simultaneously conducted using a same device or be independently conducted using separately provided devices.

The process may further include recovering the liquefied petroleum gas from the overhead stream.

Preferably, 10-95 wt % zeolite, which is at least one selected from a group consisting of mordenite, a beta type of zeolite, and a ZSM-5 type of zeolite, and which has a silica/alumina molar ratio of 200 or less, is mixed with 5-90 wt % inorganic binder to produce a support, and platinum/tin or platinum/lead is supported on the mixture support to produce the catalyst of converting step.

Meanwhile, it is preferable that the hydrocarbon feedstock be selected from a group consisting of reformate, pyrolysis gasoline, desulfurized/denitrified fluidized catalytic cracking gasoline, $C_9$+ aromatic-containing mixture, naphtha, and a mixture thereof.

According to another embodiment of the present invention, there is provided a process for increasing the production of benzene from a hydrocarbon mixture, including the following steps of:

separating a hydrocarbon feedstock into a $C_6$ or lower hydrocarbon stream and a $C_7$ or higher hydrocarbon stream;

separating the $C_6$ or lower hydrocarbons into a non-aromatic hydrocarbon stream and an aromatic hydrocarbon stream through a solvent extraction process;

feeding the $C_7$ or higher hydrocarbons and hydrogen into at least one reaction area;

converting the $C_7$ or higher hydrocarbons in presence of a catalyst in the reaction area into aromatic hydrocarbons which are rich in benzene, toluene, and xylene through dealkylation/transalkylation reactions, and non-aromatic hydrocarbons which are rich in liquefied petroleum gas through a hydrocracking reaction;

separating reaction products of the converting step into an overhead stream, which contains hydrogen, methane, ethane, and the liquefied petroleum gas, and a bottom stream, which contains the aromatic hydrocarbons, and a small amount of hydrogen and non-aromatic hydrocarbons, using a gas-liquid separation process; and combining the aromatic hydrocarbon stream separated in the $C_6$ or lower hydrocarbon separating step and the bottom stream separated in the reaction products separating step to recover benzene, toluene, xylene, and $C_9$ or higher aromatic compounds, respectively.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

Figure 1:
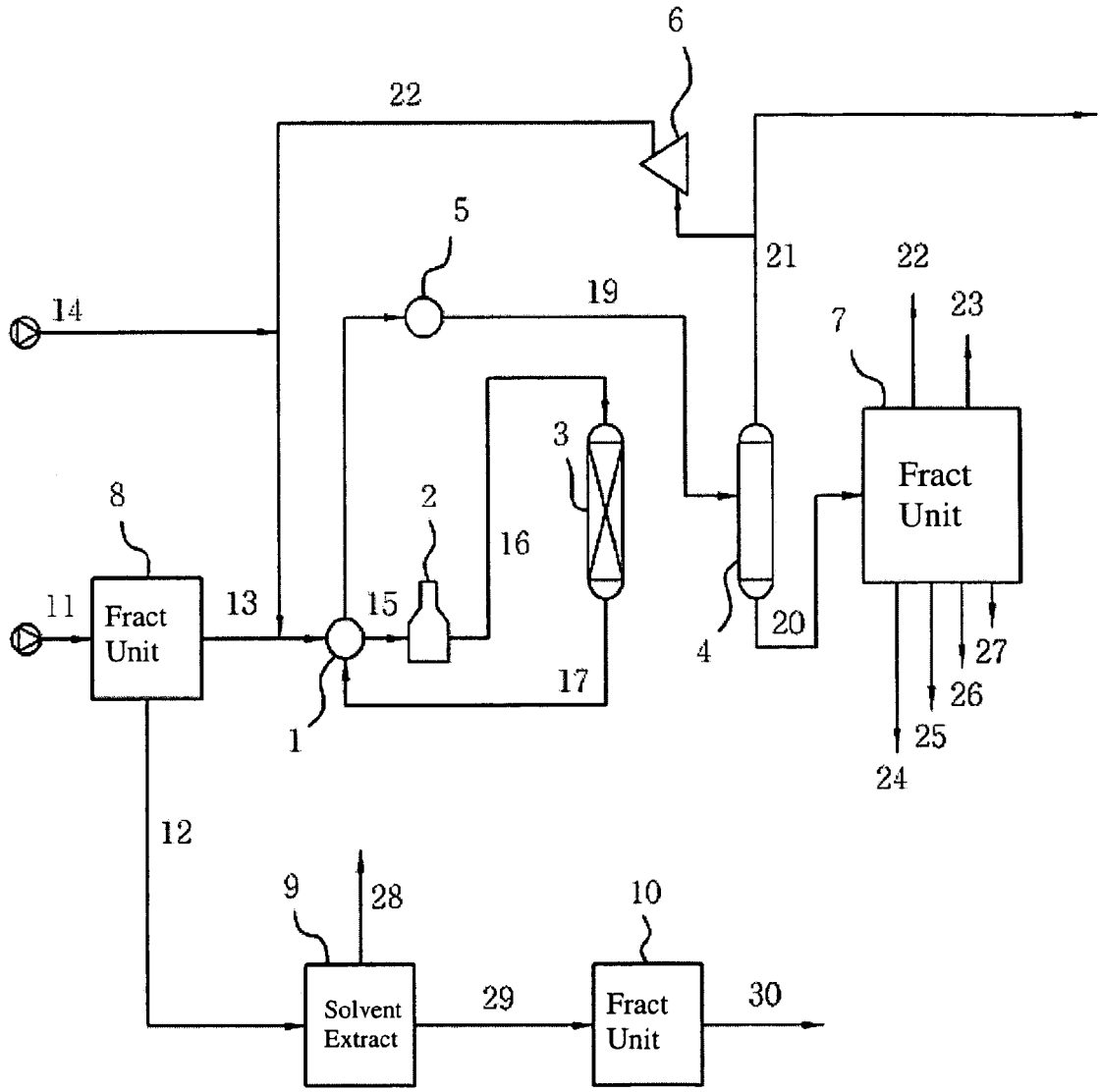
FIG. 1 illustrates one embodiment of a procedure of increasing the production of benzene from a hydrocarbon mixture, according to the present invention.

Hereinafter, a detailed description will be given of the present invention, referring to the drawings.

Figure 2:
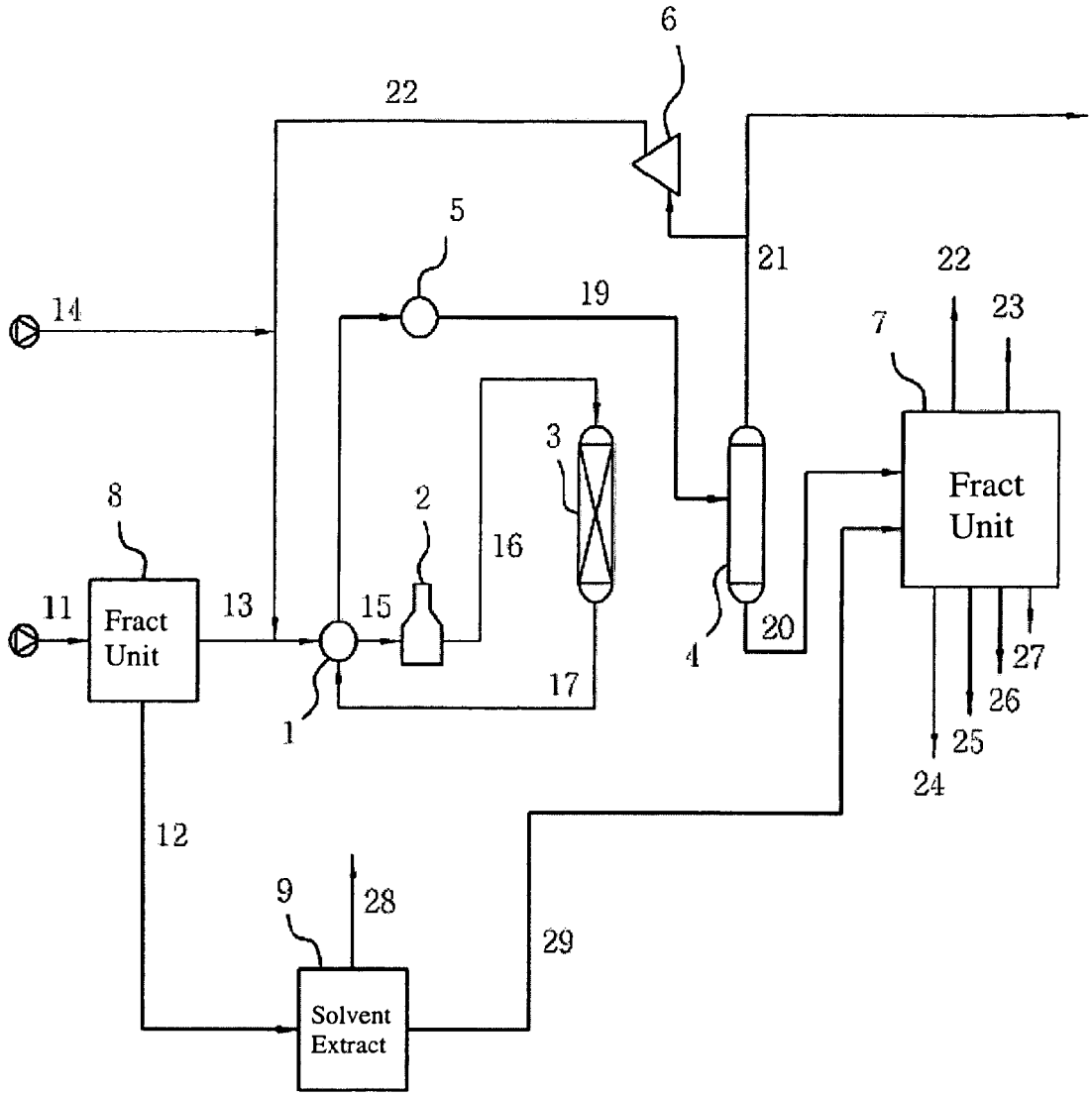
FIG. 2 illustrates another embodiment of a procedure of increasing the production of benzene from a hydrocarbon mixture, according to the present invention.

FIG. 1 illustrates a procedure for increasing the production of benzene from a hydrocarbon mixture, according to an embodiment of the present invention, and FIG. 2 illustrates another embodiment of the present invention.

With reference to FIGS. 1 and 2, a hydrocarbon feedstock 11 as feedstock oil of a process according to the present invention is separated into a fraction 12 in which the number of carbon atoms is 6 or lower and a fraction 13 in which the number of carbon atoms is 7 or higher in a fractionation unit 8. The fraction 12 in which the number of carbon atoms is 6 or lower is fed as a feedstock for a solvent extraction process 9, and the fraction 13 in which the number of carbon atoms is 7 or higher is fed as a feedstock for a process of producing aromatic hydrocarbons and LPG from a hydrocarbon mixture.

The hydrocarbon feedstock used in the present invention preferably includes hydrocarbons having a boiling point of 30-250° C., and may be selected from the group consisting of reformate, pyrolysis gasoline, desulfurized/denitrified fluidized catalytic cracking gasoline, $C_9$+ aromatic-containing mixture, naphtha, and a mixture thereof.

The fraction 13, in which the number of carbon atoms is 7 or higher and which is fed as the feedstock for the process of producing the aromatic hydrocarbons and the LPG from the hydrocarbon mixture, is mixed with circulating hydrogen 22 and highly pure hydrogen 14, and is then fed in a hydrogen/feedstock mixture form 15 into a reactor 3.

In connection with this, a separate heater 2 is provided in order to increase the temperature of the hydrogen/feedstock mixture to a reaction temperature. The hydrogen/feedstock mixture is heated to some extent 15 through heat exchange with reaction products 17 which are discharged from the reactor 3 and then fed into a heat exchanger 1, and is then fed into the heater 2.

The hydrogen/feedstock mixture 16 which is fed into the reactor 3 is subjected to dealkylation, transalkylation, and hydrogenation reactions in the presence of a catalyst.

That is to say, a hydrocracking reaction of non-aromatic hydrocarbon compounds, and the dealkylation and transalkylation reactions of aromatic hydrocarbon compounds are simultaneously carried out in the reactor 3 to produce main basic petrochemical materials, such as benzene, toluene, and xylene, and byproducts, such as LPG and non-aromatic compounds.

In connection with this, a catalyst, which is packed in the reactor 3 to cause the dealkylation, transalkylation, and hydrogenation reactions, is not limited as long as it is known to those skilled in the art, and, preferably, may be a catalyst disclosed in U.S. Pat. No. 6,635,792.

That is to say, 10-95 wt % zeolite, which is at least one selected from the group consisting of mordenite, a beta type of zeolite, and a ZSM-5 type of zeolite and which has a silica/alumina molar ratio of 200 or less, is mixed with 5-90 wt % inorganic binder to produce a support, and platinum/tin or platinum/lead is supported on the mixture support, thereby the catalyst is created.

Meanwhile, the products 17 are present in a gaseous form at a relatively high temperature after the reactions are finished, are circulated into the heat exchanger 1 before they are fed into a gas-liquid separator 4, emit heat to the hydrogen/feedstock mixture therein, and are fed into a cooler 5.

A product stream 19 passing through the cooler 5 is fed into the gas-liquid separator 4 at about 30-50° C., and is then separated into a gaseous component and a liquid component.

The gaseous component is discharged in an overhead stream 21 from the gas-liquid separator 4, and the liquid component is discharged in a bottom stream 20 therefrom. In connection with this, the gaseous component 21 includes about 60-75 mol % hydrogen and 25-40 mol % hydrocarbon components, and the hydrocarbon components include methane, ethane, and LPG which have relatively small numbers of carbon atoms. The hydrogen component is compressed by a compressor 6, mixed with highly pure hydrogen 14 which is fed to control the purity of hydrogen, and is fed in conjunction with the feedstock 13 into a reaction area. Methane, ethane, and the LPG which are contained in the overhead stream 21 may selectively be recovered using an additional distillation process.

Meanwhile, the bottom stream 20 consists mostly of aromatic components, and also includes residual hydrogen and light non-aromatic components in a small amount. Accordingly, the liquid component is additionally subjected to a separation and purification process, and is separated into residual hydrogen 22, a non-aromatic component 23, and benzene 24, toluene 25, xylene 26, and $C_9$+ aromatic compounds 27, which have purity of 99% or more, using a difference in boiling point in a fractionation unit 7.

In summary, the hydrocarbon mixture, in which the number of carbon atoms is 7 or higher, is subjected to dealkylation, transalkylation, and hydrogenation reactions in the presence of the catalyst, thereby $C_9$, $C_{10}$, and $C_{11}$ aromatic compounds are converted into benzene, toluene, and xylene.

Meanwhile, the fraction 12, which is separated by the fractionation unit 8 and is then fed as a feedstock of a solvent extraction process 9 and in which the number of carbon atoms is 6 or lower, is separated into non-aromatic hydrocarbons 28 which are nonpolar hydrocarbons and aromatic hydrocarbons 29 which are polar hydrocarbons.

As shown in FIG. 1, the aromatic hydrocarbons 29, which are the polar hydrocarbons, are fed into a fractionation unit 10 at a rear stage to produce benzene 30, or, as shown in FIG. 2, they are fed into the fractionation unit 7 of the process using the $C_7$ or higher hydrocarbon mixture as a feedstock to produce benzene 24, toluene 25, and xylene 26 using a difference in boiling point.

As described above, separate processes which are integrated in the present invention have the common object of producing aromatic hydrocarbon products, such as benzene, toluene, and xylene. However, they are different from each other in that, in one process, the contents of benzene, toluene, and xylene in feedstock oil are changed through dealkylation and transalkylation reactions using the catalyst, while, in the other process, the contents of benzene, toluene, and xylene in feedstock oil are not changed.

In the present invention, the two separate processes are integrated, the hydrocarbon mixture is separated into the fraction in which the number of carbon atoms is 6 or lower and the fraction in which the number of carbon atoms is 7 or higher, and they are, respectively, used as a feedstock in the two processes. That is to say, the hydrocarbons in which the number of carbon atoms is 7 or higher are used as the feedstock of the process for producing the aromatic hydrocarbon mixture and the LPG, and the hydrocarbons in which the number of carbon atoms is 6 or lower are used as the feedstock of the solvent extraction process for separating and recovering the polar hydrocarbons from the hydrocarbons containing the polar hydrocarbons and the nonpolar hydrocarbons. Thereby, the mixture converted through the catalytic reaction, and the fraction which is separated through extraction and is rich in benzene, toluene, and xylene are separated into benzene, toluene, xylene, and $C_9$+ aromatic compounds, respectively using a difference in boiling point through a separation device which includes a distillation column, resulting in the improved production of benzene.

Therefore, when the process for producing the highly pure aromatic hydrocarbon mixture, the LPG, and the non-aromatic hydrocarbons from the hydrocarbon feedstock, and the solvent extraction process for separating and recovering the polar hydrocarbons from the hydrocarbon feedstock containing the polar hydrocarbons and the nonpolar hydrocarbons are integrated according to the method of the present invention, it is possible to significantly improve the productivity of products in comparison with the separate use of each process.

A better understanding of the present invention may be obtained through the following examples and comparative examples which are set forth to illustrate, but are not to be construed as the limit of the present invention.

EXAMPLE 1 AND COMPARATIVE EXAMPLES 1 AND 2

It is necessary to confirm the productivities of separate processes and the integrated process according to the process of the present invention, therefore tests were conducted to achieve the confirmation in the following examples.

Comparative Example 1

The productivity of products in a solvent extraction process using pyrolysis gasolines as a feedstock was confirmed, and the results are described in the following Table 1.

TABLE 1

| Feedstock | | | | | Result | | |
|---|---|---|---|---|---|---|---|
| Flow rate | Composition (wt %) | Operation conditions Temp. | Press. | Ratio | Product (kg/hr) | Extract composition (wt %) | Raffinate composition (wt %) |
| 10 kg/hr | $C_6$ paraffin 4.48 | 90° C. | 7 kg/cm$^2$g | 2 | Benzene 4.22 | $C_{10}$+ paraffin 0.002 | $C_6$ paraffin 25.421 |
| | $C_7$ paraffin 2.58 | | | | Toluene 2.07 | $C_8$ naphthene 0.001 | $C_7$ paraffin 14.640 |
| | $C_8$ paraffin 0.9 | | | | Xylene 0.67 | Benzene 51.466 | $C_8$ paraffin 5.106 |
| | $C_9$ paraffin 0.27 | | | | Total 6.96 | Toluene 25.260 | $C_9$ paraffin 1.531 |
| | $C_{10}$+ paraffin 1.85 | | | | | Ethyl benzene 8.198 | $C_{10}$+ paraffin 10.487 |
| | $C_5$ naphthene 2 | | | | | Xylene 8.684 | $C_5$ naphthene 11.349 |
| | $C_6$ naphthene 4.16 | | | | | $C_9$+ aromatics 6.388 | $C_6$ naphthene 23.605 |
| | $C_7$ naphthene 0.61 | | | | | | $C_7$ naphthene 3.461 |
| | $C_8$ naphthene 0.47 | | | | | | $C_8$ naphthene 2.664 |
| | Benzene 42.4 | | | | | | Benzene 0.024 |
| | Toluene 20.85 | | | | | | Toluene 0.237 |

TABLE 1-continued

| Feedstock | | Operation conditions | | | Result | | |
|---|---|---|---|---|---|---|---|
| Flow rate | Composition (wt %) | Temp. | Press. | Ratio | Product (kg/hr) | Extract composition (wt %) | Raffinate composition (wt %) |
| | Ethyl benzene 6.76<br>Xylene 7.3<br>$C_9$+ aromatics 5.37 | | | | | | Ethyl benzene 0.038<br>Xylene 0.828<br>$C_9$+ aromatics 0.609 |

Temp.: Extraction temperature
Press.: Extraction pressure
Ratio: Solvent/H.C. volume Ratio

Comparative Example 2

The productivity of a process for producing aromatic hydrocarbons and LPG from a hydrocarbon mixture using pyrolysis gasolines as a feedstock was confirmed, and the results are described in the following Table 2.

TABLE 2

| Feedstock | | Operation conditions | | | Result | |
|---|---|---|---|---|---|---|
| Flow rate | Composition (wt %) | Reaction Temp. | Reaction pressure | $H_2$/H.C. molar ratio | Product (kg/hr) | Composition (wt %) |
| 10 kg/hr | $C_6$ paraffin 4.48<br>$C_7$ paraffin 2.58<br>$C_8$ paraffin 0.9<br><br>$C_9$ paraffin 0.27<br>$C_{10}$+ paraffin 1.85<br>$C_5$ naphthene 2<br>$C_6$ naphthene 4.16<br>$C_7$ naphthene 0.61<br>$C_8$ naphthene 0.47<br>Benzene 42.4<br>Toluene 20.85<br>Ethyl benzene 6.76<br>Xylene 7.3<br>$C_9$+ aromatics 5.37 | 340° C. | 30 kg/cm$^2$g | 4 | Benzene 1.93<br>Toluene 3.71<br>Xylene 2.18<br><br>Total 7.82 | $C_1$ paraffin 0.47<br>$C_2$ paraffin 7.37<br>$C_3$ paraffin 6.23<br><br>$C_4$ paraffin 3.04<br>$C_5$ paraffin 0.85<br>$C_6$ paraffin 0.11<br>$C_7$ paraffin 0.02<br>$C_8$ paraffin 0.02<br>$C_9$ paraffin 0.02<br>$C_6$ naphthene 0.02<br>$C_7$ naphthene 0.03<br>Benzene 19.31<br>Toluene 37.05<br>Xylene 21.84<br>$C_9$+ aromatics 5.64 |

Example 1

The productivity of the integrated process shown in FIG. 1 using pyrolysis gasolines as a feedstock was confirmed, and the results are described in the following Table 3.

TABLE 3

| | Solvent extraction | | Catalytic reaction | | Integration result | |
|---|---|---|---|---|---|---|
| Feedstock (wt %) | 4.94 kg/hr<br>$C_6$ paraffin 9.07<br>$C_7$ paraffin 4.29<br>Benzene 85.80<br>Toluene 0.84 | | 5.06 kg/hr<br>$C_7$ paraffin 0.12<br>$C_8$ paraffin 2.03<br>$C_9$ paraffin 0.6<br>$C_{10}$+ paraffin 4.15<br>$C_6$ naphthene 0.07<br>$C_7$ naphthene 0.68<br>$C_8$ naphthene 1.07<br>Benzene 0.8<br>Toluene 46.8<br>Ethyl benzene 15.2<br>Xylene 16.4<br>$C_9$+ aromatics 12.08 | | | |
| Operation conditions | Extraction temp. | 90° C. | Reaction temp. | 340° C. | | |
| | Extraction press. | 7 kg/cm$^2$g | Reaction press. | 30 kg/cm$^2$g | | |
| | Solvent/H.C. volume ratio | 2 | $H_2$/H.C. molar ratio | 4 | | |
| Result | Benzene | 4.15 kg/hr | Benzene | 0.97 kg/hr | Benzene | 5.12 kg/hr |

TABLE 3-continued

| Solvent extraction | | Catalytic reaction | | Integration result | |
|---|---|---|---|---|---|
| Toluene | 0.04 kg/hr | Toluene | 1.86 kg/hr | Toluene | 1.90 kg/hr |
| Total | 4.19 kg/hr | Xylene | 1.09 kg/hr | Xylene | 1.09 kg/hr |
| | | Total | 3.92 kg/hr | Total | 8.11 kg/hr |

As described above, in the present invention, after a hydrocarbon mixture is separated into a fraction in which the number of carbon atoms is 6 or lower and a residual fraction, hydrocarbons in which the number of carbon atoms is 7 or higher are used as a feedstock of a process for producing an aromatic hydrocarbon mixture and LPG, and hydrocarbons in which the number of carbon atoms is 6 or lower are fed as a feedstock of a solvent extraction process. Thereby, the mixture converted through the catalytic reaction, and the fraction which is separated through the extraction and is rich in benzene, toluene, and xylene, are separated into benzene, toluene, xylene, and $C_9$+ aromatic compounds using a difference in boiling point and a separation device which includes a distillation column, resulting in the improved production of benzene.

Therefore, when the process for producing the highly pure aromatic hydrocarbon mixture, the LPG, and the non-aromatic hydrocarbons from the hydrocarbon feedstock, and the solvent extraction process for separating and recovering polar hydrocarbons from the hydrocarbon feedstock containing the polar hydrocarbons and nonpolar hydrocarbons are integrated according to the process of the present invention, it is possible to significantly improve the productivity of products in comparison with the separate use of each process.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A process for increasing the production of benzene from a hydrocarbon mixture, comprising the following steps of:

separating a hydrocarbon feedstock into a $C_6$ or lower hydrocarbon stream and a $C_7$ or higher hydrocarbon stream;

separating the $C_6$ or lower hydrocarbons into a non-aromatic hydrocarbon stream and an aromatic hydrocarbon stream through a solvent extraction process;

recovering benzene from the aromatic hydrocarbon stream;

feeding the $C_7$ or higher hydrocarbons and hydrogen into at least one reaction area;

converting the $C_7$ or higher hydrocarbons in the presence of a catalyst in the reaction area into aromatic hydrocarbons which are rich in benzene, toluene, and xylene through dealkylation/transalkylation reactions, and non-aromatic hydrocarbons which are rich in liquefied petroleum gas through a hydrocracking reaction;

separating reaction products of the converting step into an overhead stream, which contains hydrogen, methane, ethane, and the liquefied petroleum gas, and a bottom stream, which contains the aromatic hydrocarbons, and a small amount of hydrogen and non-aromatic hydrocarbons, using a gas-liquid separation process; and recovering benzene, toluene, xylene, and $C_9$ or higher aromatic compounds, respectively from the bottom stream.

2. The process as set forth in claim 1, wherein the benzene recovering step and the benzene, toluene, xylene, and $C_9$ or higher aromatic compounds recovering step are simultaneously conducted using a same device or are independently conducted using separately provided devices.

3. The process as set forth in claim 1, further comprising the step of recovering the liquefied petroleum gas from the overhead stream.

4. The process as set forth in claim 1, wherein 10-95 wt % zeolite, which is at least one selected from a group consisting of mordenite, a beta type of zeolite, and a ZSM-5 type of zeolite, and which has a silica/alumina molar ratio of 200 or less, is mixed with 5-90 wt % inorganic binder to produce a support, and platinum/tin or platinum/lead is supported on the mixture support to produce the catalyst.

5. The process as set forth in claim 1, wherein the hydrocarbon feedstock is selected from a group consisting of reformate, pyrolysis gasoline, desulfurized/denitrified fluidized catalytic cracking gasoline, $C_9$+ aromatic-containing mixture, naphtha, and a mixture thereof.

6. A process for increasing the production of benzene from a hydrocarbon mixture, comprising the following steps of:

separating a hydrocarbon feedstock into a $C_6$ or lower hydrocarbon stream and a $C_7$ or higher hydrocarbon stream;

separating the $C_6$ or lower hydrocarbons into a non-aromatic hydrocarbon stream and an aromatic hydrocarbon stream through a solvent extraction process;

feeding the $C_7$ or higher hydrocarbons and hydrogen into at least one reaction area;

converting the $C_7$ or higher hydrocarbons in the presence of a catalyst in the reaction area into aromatic hydrocarbons which are rich in benzene, toluene, and xylene through dealkylation/transalkylation reactions, and non-aromatic hydrocarbons which are rich in liquefied petroleum gas through a hydrocracking reaction;

separating reaction products of the converting step into an overhead stream, which contains hydrogen, methane, ethane, and the liquefied petroleum gas, and a bottom stream, which contains the aromatic hydrocarbons, and a small amount of hydrogen and non-aromatic hydrocarbons, using a gas-liquid separation process; and combining the aromatic hydrocarbon stream separated in the $C_6$ or lower hydrocarbon separating step and the bottom stream separated in the reaction products separating step to recover benzene, toluene, xylene, and $C_9$ or higher aromatic compounds, respectively.

* * * * *